US005779059A

United States Patent [19]

Kotch

[11] Patent Number: 5,779,059

[45] Date of Patent: Jul. 14, 1998

[54] ORNAMENTAL EGG DISPLAY STAND

[75] Inventor: Andrew J. Kotch, 330 Howell Rd., Shavertown, Pa. 18708-9603

[73] Assignee: Andrew J. Kotch, Shavertown, Pa.

[21] Appl. No.: 639,747

[22] Filed: Apr. 29, 1996

[51] Int. Cl.[6] ..... A47F 7/00

[52] U.S. Cl. ..... 211/14; D7/611

[58] Field of Search ..... 211/14; 248/346.01, 248/174; D7/611

[56] References Cited

U.S. PATENT DOCUMENTS

| | | | |
|---|---|---|---|
| 436,604 | 11/1890 | Iske | 211/14 |
| 1,037,882 | 9/1912 | Erickson | 211/14 |
| 1,806,631 | 5/1931 | Lasher | 211/14 |
| 2,442,723 | 6/1948 | Economakis | 248/174 X |

FOREIGN PATENT DOCUMENTS

| | | | |
|---|---|---|---|
| 472866 | 4/1951 | Canada | 211/14 |
| 54211 | 1/1938 | Denmark | 211/14 |
| 6030104 | 4/1926 | France | 211/14 |
| 7304 | 4/1900 | United Kingdom | 211/14 |

*Primary Examiner*—Robert W. Gibson, Jr.

[57] ABSTRACT

This invention relates to the manufacture of a structure designed for the purpose of displaying eggs individually. The use of a durable plyable material formed in three basic sections molded into one continuous unit comprise the complete said invention. The said invention embodiment will hold a single egg in an upright position for display purposes. Adults or children that artistically decorate eggs will find said invention particularly useful and entertaining as a method of display. The invention may also advantageously encourage individuals in developing their own artistic abilities by providing a unique display form.

1 Claim, 1 Drawing Sheet

ORNAMENTAL EGG DISPLAY STAND

BACKGROUND OF THE INVENTION

1. Field of the Invention

This invention in general relates to a free standing unit which holds and displays a single egg. More specifically, with the use of a plyable material formed in a distinctive style a decorative and entertaining display unit will be created. Eggs can be displayed individually in an upright position. Displaying eggs with said invention will add a unique character to the egg unlike any other display devise. Use of said invention may be advantageous to developing creativity in its user.

2. Description of Prior Art

Egg containers are generally constructed to handle large quantities of eggs for packaging and transport. Containers made of cardboard or styrofoam are generally designed to hold half-dozen, dozen or larger number of eggs. The need for single egg containers has been very limited. But the need does arise annually, in particular, during the Easter holiday season.

Children and adults every Easter season participate in the traditional dying and displaying of eggs. Displaying of colored eggs is limited to placing them in baskets, on cardboard trays with round punch-out holes, on top of paper rolled in a cylindrical form or placed back into the cardboard or styrofoam containers in which the eggs were purchased.

If one searches store shelves long enough they may find some elementary egg holders. Present devices are limited to conical shaped wire figures or bowl shaped ceramic. There is an egg holder by D. E. Omlie (U.S. Pat. No. 304,988) and other devices used as combination egg holder and decorating stand such as V. M. Nagy (U.S. Pat. No. 354,898), D. E. Rintel (U.S. Pat. No. 330,489) and M. T. Helmer (U.S. Pat. No. 354,421). While these units may be suitable for the particular purpose they address, they would not be suitable for the purpose of the present invention as hereto described.

SUMMARY OF THE INVENTION

1. The main purpose of said invention is to provide a free standing structure that will hold individual eggs to be displayed in a unique and entertaining way.

2. An equally important purpose, said invention will provide a prominent means of display while adding value and appreciation to these seasonal works of art.

3. A third purpose, as an art aid, said invention can help expand the creativity of children and adults as it becomes an extension of the individual's artistic creation.

4. A fourth important purpose, said invention will enhance the fun and pleasure of children and adults as they dye, paint or decorate eggs, in particular for the Easter holiday season.

5. An additional purpose is to provide a simple, child friendly, art aid. No assembly required, no moving parts and lightweight.

DESCRIPTION OF INVENTION

The purpose of said invention can be achieved through the molding of a plyable material into the proper form. Said invention consists of three basic molded sections, the egg holder, the legs and the feet. All three sections, when molded together, will form one free standing continuous unit.

The upper section of the mold referred to as the egg holder, will be in the shape of a hollow cylindrical band. The cylindrical shape will be of a diameter able to retain an egg in an upright position without the egg slipping through.

The middle section of the mold referred to as the legs will consist of 2 long cylindrical extensions attached to the egg holder. They will be attached at opposite sides of the egg holder diameter with each leg extending in the same direction, downward, to serve as support for the upper section, the egg holder. The length of the legs may vary from one complete molded unit to another to give the ORNAMENTAL EGG DISPLAY STAND invention a variety of heights.

The bottom section of the form referred to as feet consists of 2 molded forms in the shape of webbed feet. They will have flat bottoms with the upper surface arching upward. These 2 forms are molded directly to the legs and serve as the base of said invention.

All three sections are molded together to form one continuous unit. This will allow said invention to stand upright freely while holding a single egg in the upper most egg holder section of the invention.

DETAILED DESCRIPTION OF DRAWINGS

Figure 1:
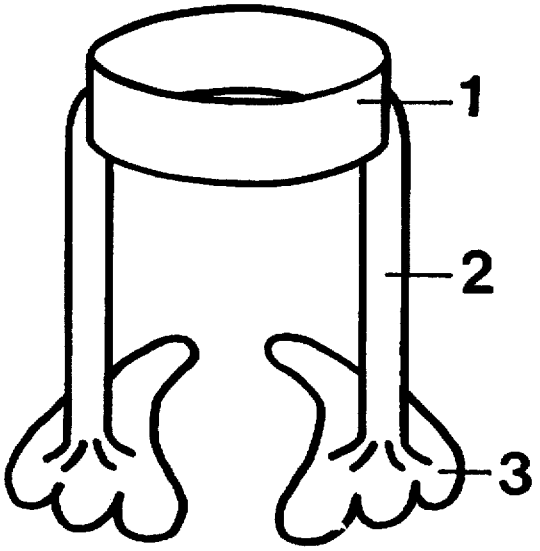
FIG. 1 is a front, top perspective of the complete Ornamental Egg Display Stand showing the 3 main segments, the egg holder, legs and feet as one continuous unit.

As shown in FIG. 1, the Ornamental Egg Display Stand consists of three main elements. The egg holder1, the legs 2 and the feet 3. When all three elements are molded into one unit said invention becomes free standing able to hold a single egg in its upper most section for display. Said invention will be constructed preferable with a strong rubber-like or plastic molding material.

Figure 2:
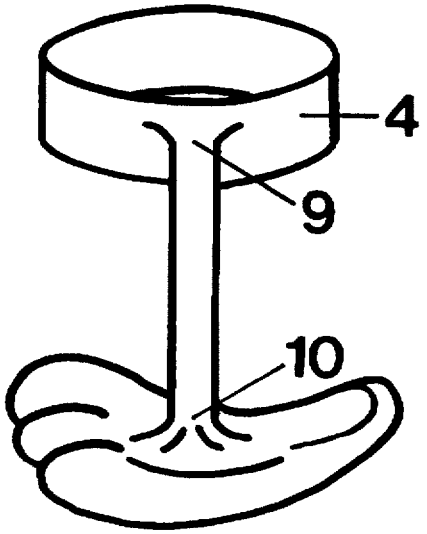
FIG. 2 is a side, top perspective of the complete Ornamental Egg Display Stand showing the side molding of the egg holder, legs and feet.

The upper most section, the egg holder 1, is a hollowed out cylindrical shape with a side wall FIG. 2 number 4 of appropriate height and thickness. The egg holder interior diameter FIG. 3 number 5 may vary in accordance with egg diameters.

Figure 4:
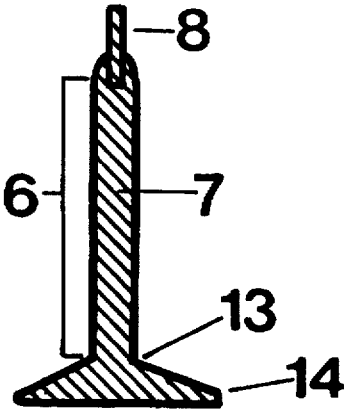
FIG. 4 is a front cut-away perspective of the molding showing the egg holder, leg and feet connecting points and feet thickness from center point to outer edge.

The mid-section legs 2 may vary in length with pairs being equal. This measurement is taken FIG. 4 from the top surface of the feet to the bottom edge of the egg holder 6. The leg diameter 7 will be of appropriate thickness for strength. The egg holder 8 will run through the center of the leg diameter 7 allowing the legs to be molded to both the interior and exterior walls 8 of the egg holder creating better support and stability.

The point at which the legs and egg holderjoin FIG. 2, the molding will fan out 9 to blend with the contour of the egg holder. The legs will also be molded into the feet 10 creating one continuous mold. The feet will be at their highest point FIG. 4 at the center where the legs and feet meet 13. There will be a moderate sloping downward away from the center of the feet 13 to the perimeter of the feet 14.

Figure 3:
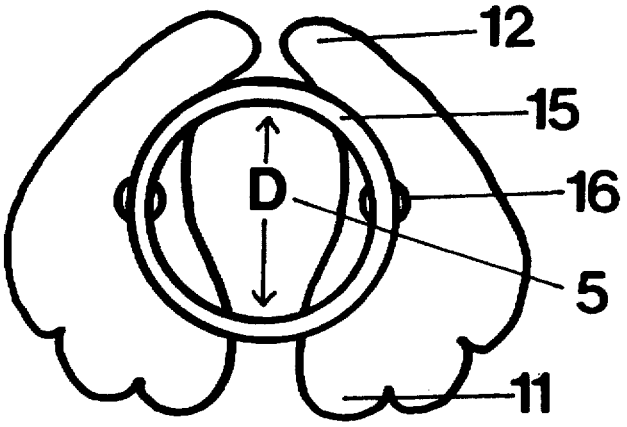
FIG. 3 is an overhead perspective of the Ornamental Egg Display Stand showing the size and positioning of the egg holder, legs and feet in relation to each other.

The base of the invention consists of two feet 3. They will be molded in the shape of webbed feet, one left foot, one right foot FIG. 3. The feet will be widest at the front with three toes 11 arching to the rear where they narrow to form the heels 12. FIG. 3 shows a top view configuration of the feet in relation to the legs and egg holder. The feet will arch outward beyond the perimeter of the egg holder 15. The legs will join the feet midway the length of the feet and favoring the inner arch of the feet at the mid-point 16.

The diameter of the egg holder, as stated earlier may vary. This variation in size will determine the distance between the legs which in turn will determine the distance between the feet. The legs should always be connected to the feet in accordance with the previous stated preferable approximate locations to create a proper balance for the embodiment.

What is claimed is:

1. A manufactured free standing unit for the purpose of holding and displaying an egg in an elevated position, comprising:

(a) a hollow cylindrical member having sufficient diameter to prevent an egg from passing through, (b) a pair of elongated support members of equal length to elevate said hollow cylindrical member, attached to said hollow cylindrical member at opposite sides of its diameter and both extending in a similar downward direction, (c) a pair of broad flat base members joined to said elongated support members to stabilize and maintain an upright position of said elongated support members and cylindrical member.

* * * * *